US006742862B2

(12) United States Patent
Yamada et al.

(10) Patent No.: US 6,742,862 B2
(45) Date of Patent: Jun. 1, 2004

(54) PRINT HEAD PURGING UNIT THAT SELECTS NOZZLE ROW TO BE PURGED USING ROTATING MEMBER

(75) Inventors: Noriyuki Yamada, Tsushima (JP); Takaichiro Umeda, Nagoya (JP); Hiroshi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/206,335

(22) Filed: Jul. 29, 2002

(65) Prior Publication Data

US 2002/0186271 A1 Dec. 12, 2002

Related U.S. Application Data

(62) Division of application No. 09/662,730, filed on Sep. 15, 2000, now Pat. No. 6,467,872.

(30) Foreign Application Priority Data

Sep. 16, 1999 (JP) ..... 11-261525

(51) Int. Cl.[7] ..... B41J 2/165

(52) U.S. Cl. ..... 347/30; 347/23

(58) Field of Search ..... 347/30, 29, 23, 347/33, 24, 14, 16, 104

(56) References Cited

U.S. PATENT DOCUMENTS 6,312,093 B1 * 11/2001 Saijo et al. ..... 347/30
6,447,094 B1 * 9/2002 Berg et al. ..... 347/22

* cited by examiner

*Primary Examiner*—Shih-Wen Hsieh
(74) *Attorney, Agent, or Firm*—Oliff & Berridge, PLC

(57) ABSTRACT

An ink jet printer includes a print head, a cap member, a suction pump, a switching mechanism. The cap member is formed with partition walls. When the cap member and the print head are placed in intimate contact, the partition walls define partitioned chambers around nozzle rows of the print head, so the nozzle rows are isolated from each other. The switching mechanism has a switching member that, by rotating, selectively switches the suction pump into fluid communication with one at a time of the partitioned chambers and out of fluid communication with any partitioned chamber other than a selected partitioned chamber. The suction pump is driven to perform a purge operation on only the nozzle row in the partitioned chamber selected by the switching mechanism.

4 Claims, 10 Drawing Sheets

OFF CONDITION (0°)

WAITING CONDITION (348°)

A SUCTION (33°)

B SUCTION (123°)

C SUCTION (213°)

D SUCTION (303°)

ON DETECTION (332°)

13a
13b
13c
13d
13e
13f
WAITING CONDITION
SUCTION

DISCHARGE

WAITING CONDITION

PRINT HEAD PURGING UNIT THAT SELECTS NOZZLE ROW TO BE PURGED USING ROTATING MEMBER

This is a Division of application Ser. No. 09/662,730 filed Sep. 15, 2000, now U.S. Pat. No. 6,467,872. The entire disclosure of the prior application is hereby incorporated by reference herein in its entirety.

BACKGROUND OF THE INVENTION

1. Field of the Invention

The present invention relates to an ink jet printer that includes a print head formed with rows of ink jet nozzles and a purge mechanism for purging each nozzle row of the print head separately.

2. Description of the Related Art

Ink jet printers include a print head formed with nozzle rows for ejecting ink onto a recording medium. The nozzles can become clogged with dried ink, dust, or other matter, so that proper ink ejection can not be performed. To prevent this, ink jet printers are also provided with a purge mechanism for purging the nozzles. The purge unit has a suction pump in fluid communication with a purge cap of a maintenance cap for covering the print head.

Purge operations are performed during periods when the print head is not being used for printing. During such a period, the purge cap is fitted over the print head, and the suction pump is driven to generate a negative pressure in the purge cap. As a result, ink is sucked from the nozzles of the print head, thereby flushing out the nozzles to prevent the nozzles from getting clogged.

There is a conventional color ink jet printer including a print head formed with a separate nozzle row for ejecting each different color ink. When each nozzle row is for ejecting a different color, it is desirable to purge each nozzle row separately.

There are two methods for selectively purging nozzles rows. In a first method, the print head is transported until the nozzle row to be purged is aligned with the purge cap. A suction pump connected to the purge cap is driven to purge the head once the nozzle row is aligned with the purge cap.

In a second method, the maintenance cap is formed with a separate suction path from the suction pump to each nozzle row. A solenoid or special drive source is provided for selectively opening and closing the suction paths to bring the suction pump into and out of fluid communication with the maintenance cap. The suction pump is driven to purge the head, once the desired suction path between the suction pump and the maintenance cap is opened.

SUMMARY OF THE INVENTION

However, the first method requires that the print head be moved to select a particular color nozzle row. The second method requires a separate drive source so that operation is complicated and the number of required components is increased.

It is an objective of the present embodiment to overcome the above-described problems and to provide an ink jet printer with a purge mechanism capable of easily selecting and purging a desired row of nozzles without requiring provision of a special drive source of complicated operations of the print head.

In order to achieve the above-described objectives, an ink jet printer according to the present invention includes a print head, a cap member, a suction pump, a switching mechanism, a selection unit, and a suction pump drive unit.

The print head has a nozzle surface formed with a plurality of nozzle rows.

The cap member is in intimate contact with the nozzle surface of the print head. The cap member is formed with partition walls that define partitioned chambers around the nozzle rows. The cap member is also formed with suction holes in a one-to-one correspondence with the partitioned chambers. Each suction hole being in fluid communication with a corresponding one of the partitioned chambers.

The suction pump generates a negative pressure.

The switching mechanism is connected to the suction holes of the cap member and to the suction pump. The switching mechanism has a switching member that, by rotating, selectively switches the suction pump into fluid communication with one at a time of the partitioned chambers through the corresponding suction hole and out of fluid communication with any partitioned chamber other than a selected partitioned chamber.

The selection unit is for driving rotation of the switching member of the switching mechanism to select one of the plurality of partitioned chambers.

The suction pump drive unit drives the suction pump to develop a negative pressure in the selected partitioned chamber through the switching mechanism and the corresponding suction hole, thereby purging the corresponding nozzle row.

With this configuration, the cap member caps the print head so that each nozzle row formed in the ink jet head is partitioned from the other. When a purge operation is to be performed, the selection unit drives the switching member of the switching mechanism to rotate in order to bring the suction pump into fluid communication with a desired partitioned chamber and also in order to close off fluid communication between the suction pump and the other partitioned chambers. Then, the suction pump operation unit operates the suction pump to perform a purge operation on the desired partitioned chamber selected by the selection unit through the switching mechanism.

Because each partitioned chamber formed in the cap member can be separately brought into and out of fluid communication with the suction pump by using a simple rotation operation, configuration of the printer can be simplified and the size of the printer can be reduced.

It is desirable that a shared drive source be further provided for driving both the suction pump and the switching mechanism. Because the switching mechanism and the suction pump is operated by a shared drive source, there is no need to provide a separate drive source for the switching mechanism, and the size of the printer can be even further reduced.

It is desirable that the shared drive source be a rotating sheet feed motor for transporting recording sheets toward the print head, and that the selection unit and the suction pump drive unit be configured from a gear mechanism for transmitting rotation from the shared drive source. In this case, the gear mechanism includes a planetary gear that pivots between a position for driving rotation of the switching member in the switching mechanism and a position for driving the suction pump.

With this configuration, when a purge operation is to be performed on a particular nozzle row, the sheet supply motor is driven in the direction to move the planetary gear to the position for driving the switching mechanism. Once the planetary gear and a gear member of the switching mechanism are in meshing engagement, the rotational drive force of the sheet supply motor is transmitted to the switching mechanism through the planetary gear in order to select the particular nozzle row. Next, the sheet supply motor is driven in the opposite direction to move the planetary gear into the position for driving the suction pump. Once the planetary gear is in meshing engagement with a gear for driving the suction pump, the rotational drive force of the sheet supply motor is transmitted to the suction pump through the planetary gear to perform a purge operation on the selected nozzle row through the corresponding partitioned chamber.

In this way, the sheet feed motor is used as the drive source for selecting the partitioned chamber where purging is to take place and also as the drive source for driving the suction pump. As a result, the number of components required for producing the ink jet printer can be reduced because a sheet feed motor is already provided to ink jet printers. Also, there is no need to perform complicated operations such as moving the print head to a selected partitioned region.

It is desirable that a control unit be further provided to control the sheet feed motor to 1) rotate in one direction to move the planetary gear into the position for driving rotation of the switching member and further to drive rotation of the switching member to select one of the partitioned chambers and then 2) rotate in another direction to move the planetary gear into the position for driving the suction pump and further to drive the suction pump.

With this configuration, to select a desired partitioned chamber, the control unit drives the sheet supply motor in the direction appropriate for moving the planetary gear into the position for driving the switching mechanism. The control unit further drives the sheet supply motor in the same direction to select the desired partitioned chamber. Once the desired partitioned chamber has been selected, the control unit drives the supply motor in the opposite direction to move the planetary gear to the position for driving the suction pump. The control unit continues to drive the sheet supply motor in this direction to drive the suction pump. As a result, the nozzle row positioned in the selected partitioned chamber is purged. The desired partitioned chamber can be easily selected and the suction pump can be easily driven using the same sheet supply motor, which is already an essential component of ink jet printers.

It is desirable that each nozzle row in the print head be for ejecting a different color ink, and that each partitioned chamber of the cap member surrounds a different nozzle row. With this configuration, purge operations can be performed on nozzle rows separately by color efficiently using a simple configuration.

It is desirable that the switching mechanism include a cylindrical base member, the switching member, and a gear member.

The cylindrical base member has a bottom surface and an outer circular peripheral surface. The bottom surface is formed with a discharge port in fluid communication with the suction pump. The outer circular peripheral surface is formed with suction ports in fluid communication with corresponding ones of the suction holes of the cap member.

The switching member has a cylindrical shape and is rotatably fitted in the cylindrical base member. The cylindrical switching member has a circular outer peripheral surface formed with a plurality of first communication holes and a second communication hole, all in fluid communication with the discharge port of the base member. The first communication holes are provided in a one-to-one correspondence with the suction holes of the base member to simultaneously establish fluid communication between all the suction holes and the discharge port of the base member when the communication holes and the suction holes are aligned. The second communication hole is provided at a position shifted from positions of the first communication holes for selectively establishing fluid communication between one of the suction ports and the discharge port of the base member to enable purge operations using the suction pump through the selected one of the partitioned chambers.

The gear member is rotated by the planetary gear of the gear mechanism when the planetary gear is in the position for driving rotation of the switching member and rotates the switching member with respect to the base member when rotated by the planetary gear.

With this configuration, all of the partitioned chambers formed separately for each different color nozzle row can be maintained in fluid communication with the discharge port of the base member by positioning the first communication holes of the switching member into alignment with suction holes formed in the outer surface of the base member.

On the other hand, when a purge operation is to be performed on a particular one of the nozzle rows, the sheet supply motor is rotated in the direction for bringing the planetary gear of the gear mechanism into meshing engagement with the gear member of the switching mechanism. The gear member of the switching mechanism is then rotated by continuing to rotate the sheet supply motor in this condition, so that the switching member rotates in association with rotation of the gear member, until the second communication hole of the switching member is aligned with the desired suction hole that is in fluid communication with the partitioned chamber where the nozzle row to be purged is located. At this time, all of the first communication ports are moved to positions out of alignment with all of the suction holes.

After suction color selection is executed in this way, the sheet supply motor is rotated in the opposite direction to move the planetary gear to the position for driving the suction pump. By continuing to drive the sheet supply motor in the same direction, the suction pump is operated to performed a purge operation on the selected nozzle row for the desired color ink.

It is desirable that the suction pump include a discharge port in fluid communication with atmosphere. All nozzle rows are brought into fluid communication with atmosphere through the discharge port of the suction pump when the first communication holes are simultaneously aligned with corresponding suction holes. With this configuration, while purge operations are not being performed, the first communication holes of the switching member are positioned in alignment with the suction holes provided in the outer surface of the base member. By doing this, the partitioned chambers formed in the cap member for each nozzle row are maintained in communication with atmosphere through the discharge port of the suction pump. As a result, no positive pressure will be applied to the ink jet nozzles even if this condition is maintained for long periods of time.

According to another aspect of the present invention, a purge unit has substantially the same configuration as the ink jet printer according to the present invention, but without provision of a print head.

BRIEF DESCRIPTION OF THE DRAWINGS

The above and other objects, features and advantages of the invention will become more apparent from reading the following description of the embodiment taken in connection with the accompanying drawings in which:

FIG. 3 (B) is a plan view showing the switching mechanism of FIG. 3(A);

FIG. 4 (B) is a plan view showing the switching mechanism of FIG. 4(A);

FIG. 5 (B) is a cross-sectional view showing the base member of FIG. 5 (A);

FIG. 6 (B) is a cross-sectional view showing the switching member of FIG. 6 (A);

FIG. 6 (C) is a side view partially in phantom showing the switching member of FIG. 6 (A);

DETAILED DESCRIPTION OF THE EMBODIMENT

Figure 1:
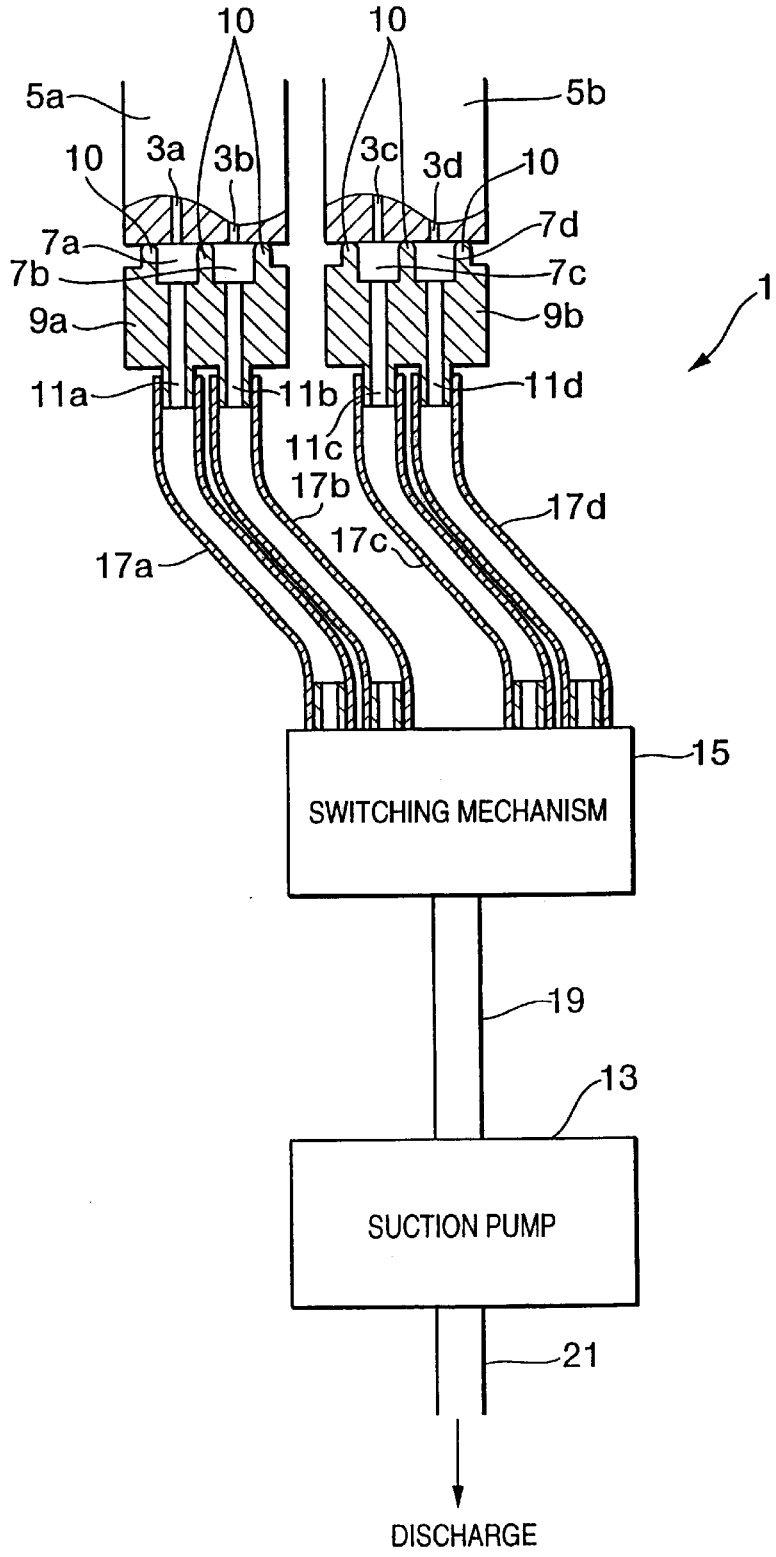
FIG. 1 is a cross-sectional view schematically showing a purge unit according to an embodiment of the present invention.

A purge unit 1 according to an embodiment of the present invention will be described while referring to the accompanying drawings. As shown in FIG. 1, the purge unit 1 according to the present embodiment is provided in an ink jet printer with two ink jet heads 5*a*, 5*b*. Each ink jet head 5*a*, 5*b* is formed with two nozzle rows each, that is, with nozzle rows 3*a*,3*b* and 3*c*, 3*d*, respectively. Each nozzle row 3*a* to 3*d* is for ejecting one of cyan, magenta, yellow, or black colored ink.

The purge unit 1 includes two maintenance caps 9*a*, 9*b*, four tubes 17*a* to 17*d*, a switching mechanism 15, a suction pump 21, a suction pump tube 19, and a discharge tube 21. The maintenance caps 9*a*, 9*b* are for covering the print heads 5*a*, 5*b*, respectively. Although not shown in the drawings, the printer includes configuration for bringing the maintenance caps 9*a*, 9*b* into and out of intimate contact with the print heads.

The maintenance cap 9*a* is formed with partition walls 10 and suction holes 11*a*, 11*b*. The partition walls 10 define partitioned chambers 7*a*, 7*b* around the nozzle rows 3*a*, 3*b*, respectively, to isolate the nozzle rows 3*a*, 3*b* from each other. The suction holes 11*a*, 11*b* are in fluid communication with the partitioned chambers 7*a*, 7*b*, respectively. The tubes 17*a*, 17*b* connect a corresponding one of the suction holes 11*a*, 11*b* with the switching mechanism 15.

Similarly, the maintenance cap 9*b* is formed with partition walls 10 and suction holes 11*c*, 11*d*. The partition walls 10 of the maintenance cap 9*b* define partitioned chambers 7*c*, 7*d* around the nozzle rows 3*c*, 3*d*, respectively, to isolate the nozzle rows 3*c*, 3*d* from each other. The suction holes 11*c*, 11*d* are in fluid communication with the partitioned chambers 7*c*, 7*d*, respectively. The tubes 17*c*, 17*d* connect a corresponding one of the suction holes 11*c*, 11*d* with the switching mechanism 15.

Figure 3A:
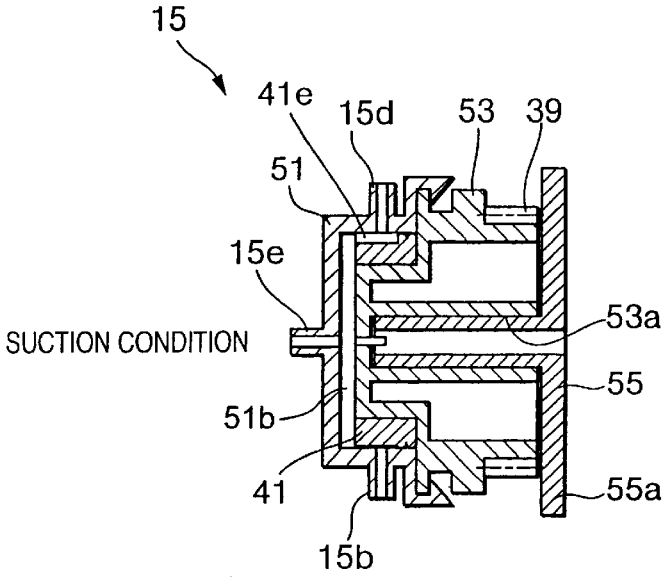
FIG. 3 (A) is a cross-sectional view showing a switching mechanism in a suction condition.
Figure 3B:
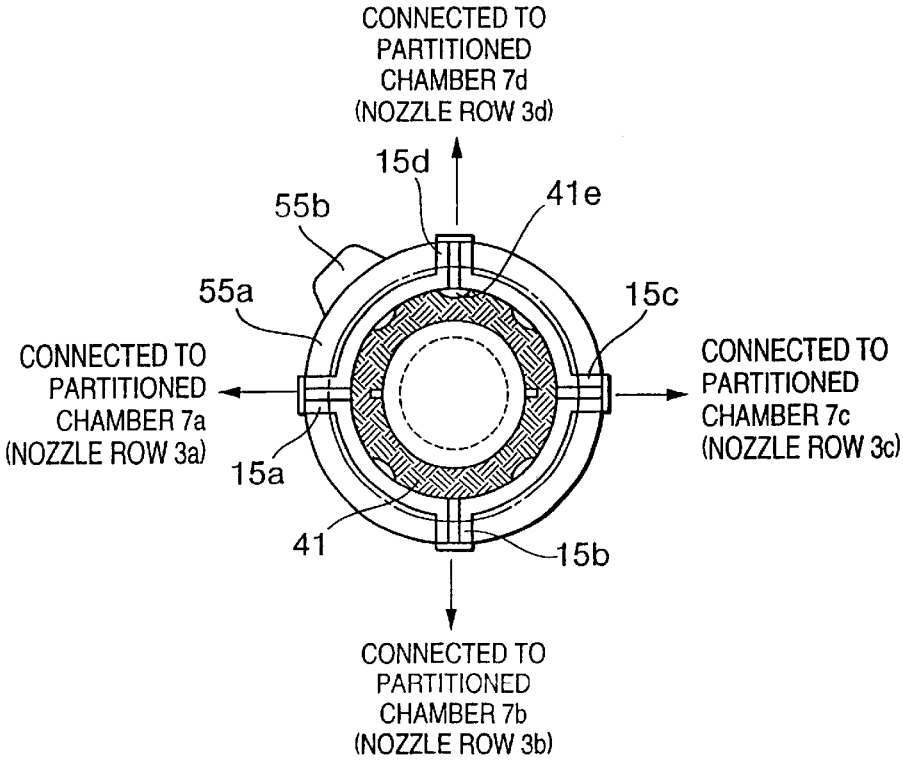

As will be described in greater detail later with reference to FIGS. 3 (A) to 7, the switching mechanism 15 includes a rotatable color row switching member 41 that is rotated to selectively bring one of the nozzle rows 3*a* to 3*d* into fluid communication with the suction pump 13 to perform a purge operation. The single suction pump tube 19 connects the switching mechanism 15 and the suction pump 13. The discharge tube 21 leads to a tank or other sink for the ink sucked from the nozzles of the nozzle rows 3 by the suction pump 13.

Figure 2:
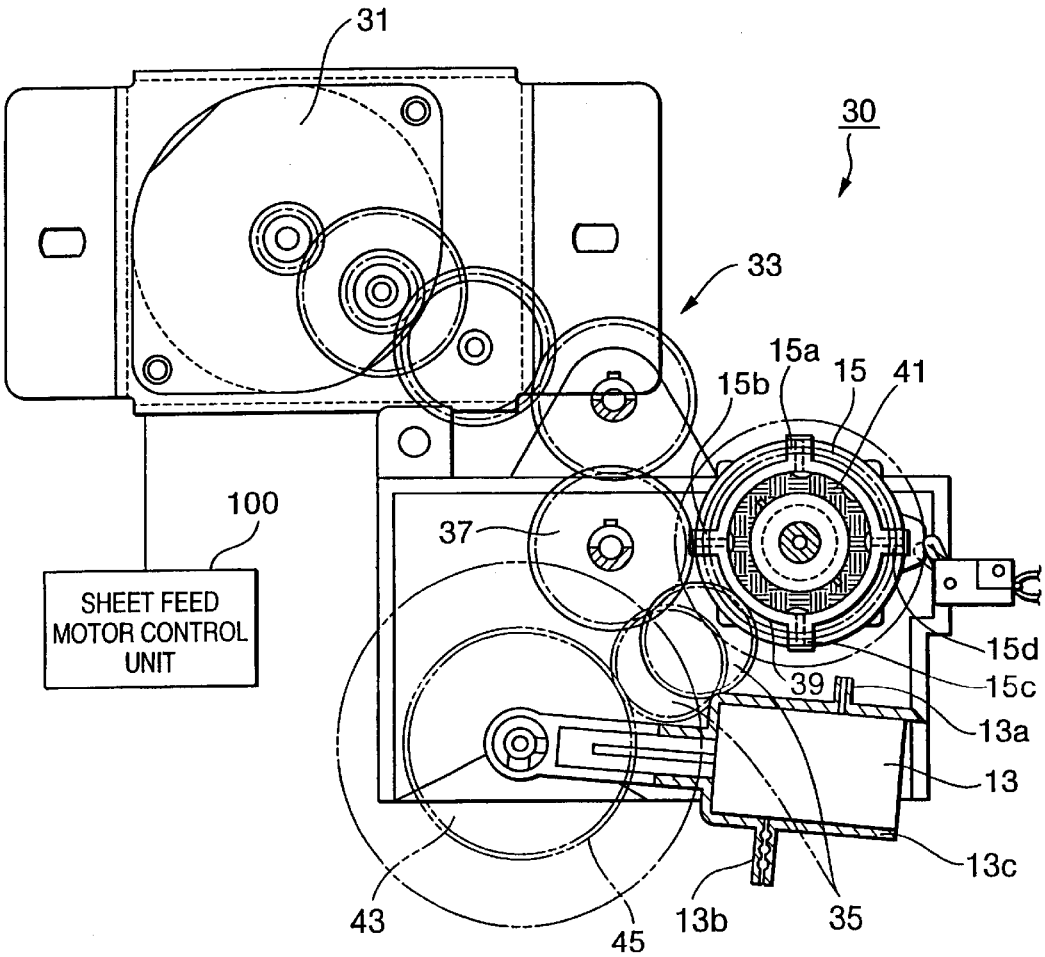
FIG. 2 is a plan view showing a drive mechanism for driving a switching mechanism to select a particular nozzle row 3 to be purged and for driving a suction pump to perform a purge operation on the selected nozzle row.

Next, an explanation will be provided while referring to FIG. 2 for a drive mechanism 30 that includes a sheet feed motor 31, a sheet feed motor control unit 100 such as a central processing unit (CPU) for controlling reversible rotation of the sheet feed motor 31, and a gear mechanism 33 driven by the sheet feed motor 31. The drive mechanism 30 uses the single shared sheet feed motor 31 to drive both rotation of the switching member 41 of the switching mechanism 15 to select one of the nozzle rows 3*a* to 3*d* and also the suction pump to develop a negative pressure in the partitioned chamber corresponding to the selected nozzle row. The gear mechanism 33 includes a sun gear 37 and a planetary gear 35 pivotable around the sun gear 37.

First, the sheet feed motor control unit 100 controls the sheet feed motor 31 to pivot the planetary gear 35 in the counterclockwise direction shown in FIG. 2 around the sun gear 37, until the planetary gear 35 meshingly engages with a gear 39 of the switching mechanism 15 as shown in solid line in FIG. 2. In this condition, the control unit 100 further drives the sheet feed motor 21 to rotate the switching member 41 of the switching mechanism 15 to, in a manner to be described later, select one of the nozzle rows 3*a* to 3*d* and bring the selected nozzle row into fluid communication with the suction pump 13.

After the color nozzle row is selected, then the control unit 100 controls the sheet feed motor 31 to rotate in the opposite direction. As a result, the planetary gear 35 pivots around the sun gear 37 in the clockwise direction as viewed in FIG. 2, into meshing engagement with a gear 45 of a cam member 43 provided for driving the suction pump 13 as indicated by single dot chain line in FIG. 2. The control unit 100 controls the sheet feed motor 31 to further rotate in the same direction, so that the suction pump 13 is driven to perform a purge operation.

Next, configuration of the switching mechanism 15 will be described with reference to FIGS. 3 (A) to 7. As shown in FIGS. 3 (A) to 4 (B), the switching mechanism 15 includes a base member 51, the switching member 41 rotatably fitted in the base member 51, an intermediate member 53 fixed to the switching member 41, and a top member 55 fitted into a center hole 53*a* of the intermediate member 53.

Figure 5A:
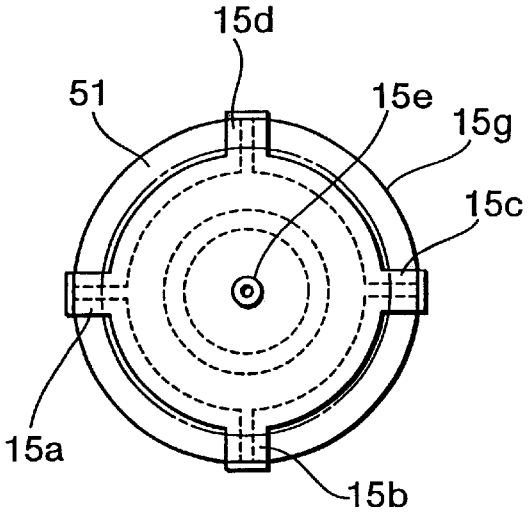
FIG. 5 (A) is a plan view showing a base member of the switching mechanism of FIGS. 3 (A) to 4 (B)
Figure 5B:
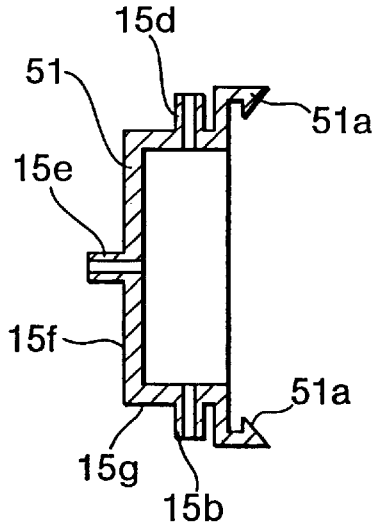

As shown in FIGS. 5 (A) and 5 (B), the base member 51 has substantially a cylindrical shape, with a base 15*f* and an outer circular periphery 15*g*. A discharge port 15*e* is formed in the base 15*f*. The discharge port 15*e* is connected to the suction pump 13 through the suction pump tube 19. Four outwardly radially protruding suction holes 15*a* to 15*d* are formed in the outer circular periphery 15*g*. The suction holes 15*a* to 15*d* are separated from each other by an interval of 90 degrees. The base member 51 is also formed with a pawl 51*a* for grasping the intermediate member 53 and preventing the intermediate member 53 from slipping out.

Figure 6A:
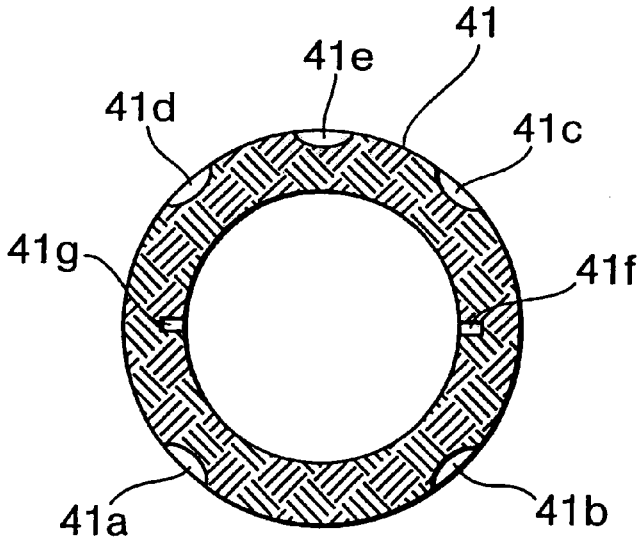
FIG. 6 (A) is a plan view showing a switching member of the switching mechanism of FIGS. 3 (A) to 4 (B)
Figure 6B:
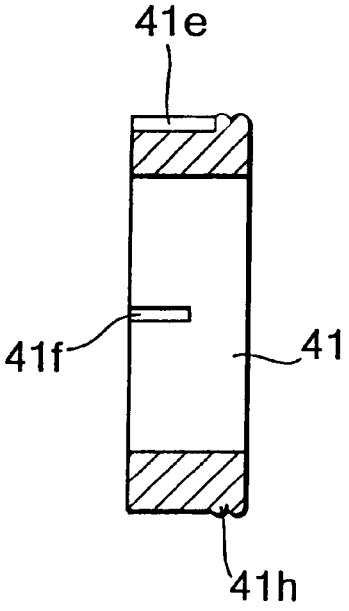
Figure 6C:
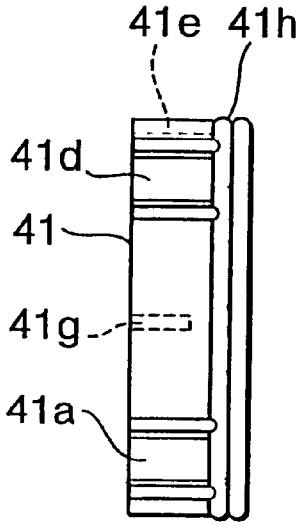

As shown in FIGS. 6 (A) to FIG. 6 (C), the switching member 41 is formed in a ring shape. Four first indentations 41*a* to 41*d* and a single second indentation 41*e* are formed in the outer periphery of the switching member 41. The four first indentations 41*a* to 41*d* are separated from each other by an interval of 90 degrees. The single second indentation 41*e* is located between the first indentations 41*c*, 41*d*, shifted by an interval of 45 degrees from both the indentations 41*c*, 41*d*. As shown in FIGS. 3 (A) and 4 (A), the first indentations 41*a* to 41*d* and the second indentation 41*e* are in fluid communication with the discharge port 15*e* through a space 51*b* defined by the switching member 41, the intermediate member 53, and the interior wall of the base member 51.

Therefore, when the switching member 41 is rotated to align the second indentation 41*e* with one of the suction holes 15*a* to 15*d* of the base member 51, then the selected suction hole 15*a*, 15*b*, 15*c*, or 15*d* will be brought into fluid communication with the discharge port 15*e*, and consequently with the suction pump 13, so that a channel is opened between the suction pump 13 and the partitioned chamber that corresponds to the selected suction hole 15*a*, 15*b*, 15*c*, or 15*d*. At this time, all of the first indentations 41*a* to 41*d* will be shifted 45 degrees out of alignment from the suction holes 15*a* to 15*d*, so that only one nozzle row is selected. FIGS. 3 (A) and 3 (B) show the switching mechanism 15 after the switching member 41 was rotated to align the second indentation 41*e* with the suction hole 15*d*, to perform a purge operation on the particular color nozzle row connected to the suction hole 15*d*.

Figure 4A:
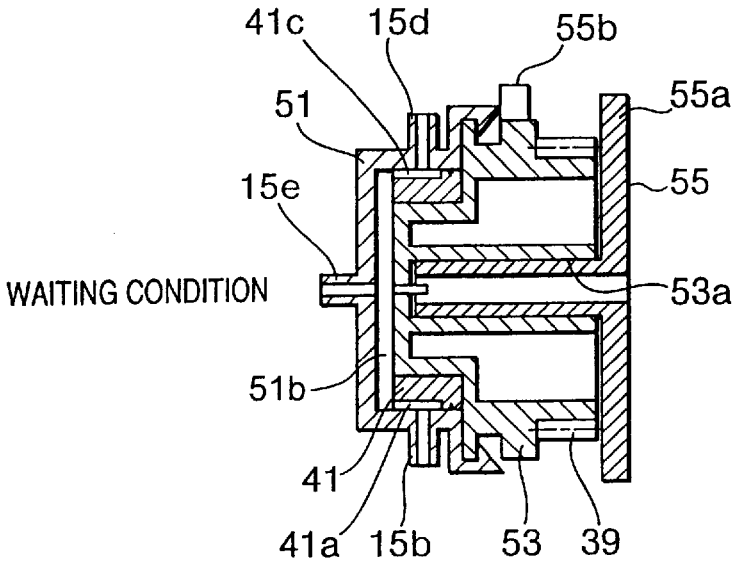
FIG. 4 (A) is a cross-sectional view showing the switching mechanism in a waiting condition.
Figure 4B:
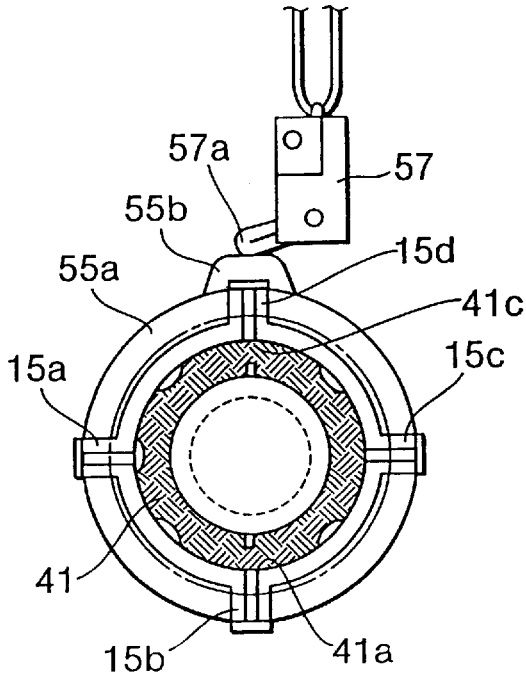

On the other hand, when the switching member 41 is rotated to align the first indentations 41*a* to 41*d* with the suction holes 15*a* to 15*d* as shown in FIGS. 4 (A) and 4 (B), then all of the suction holes 15*a* to 15*d* are brought into fluid communication with the discharge port 15*e*, and all the partitioned chambers 7 of the maintenance caps 9 are brought into fluid communication with atmosphere through the suction pump 13. At this time, the second indentation 41*e* will be shifted 45 degrees out of alignment from the suction holes 15*a* to 15*d*.

The switching member is also formed with two cut out portions 41*f*, 41*g* in its inner surface. The two cut out portions 41*f*, 41*g* are for engaging the intermediate member 53 with the switching member 41. The switching member 41 is formed at its upper edge with a lip 41*h* for maintaining a sealed condition with the inner surface of the base portion 51.

Figure 7:
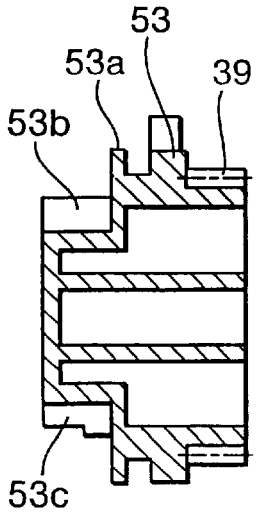
FIG. 7 is a cross-sectional view showing an intermediate member of the switching mechanism of FIGS. 3 (A) to 4 (B)

As shown in FIG. 7, the intermediate member 53 is formed at its outer peripheral surface with the gear 39, which the planetary gear 35 engages with to select a color nozzle row to be purged as described previously. The intermediate member 53 is provided at its base with extension plates 53*b*, 53*c* for engaging with the cut out portions 41*f*, 41*g* of the switching member 41, so that the intermediate member 53 and the switching member 14 rotate integrally when the intermediate member 53 is driven to rotate by the planetary gear 35. The intermediate member 52 is also provided with a flange 53*a* for engaging with the pawls 51*a* of the base member 51.

The upper edge of the top member 55 includes a flange-shaped extension 55*a* and a protrusion 55*b*. The protrusion 55*b* is for detecting a start position and is provided at a portion of the extension 55*a*. The protrusion 55*b* detects the start position by contacting a detection rib 57*a* of a micro switch 57 in a manner to be described later.

Next, the operation of the switching mechanism 15 for selecting a color nozzle row to be suctioned will be explained while referring to FIGS. 8 to 14. Description of the orientation of the switching member 15 will assume that the switching member 15 is oriented 0 degrees when in the OFF condition shown in FIG. 8.

Figure 8:
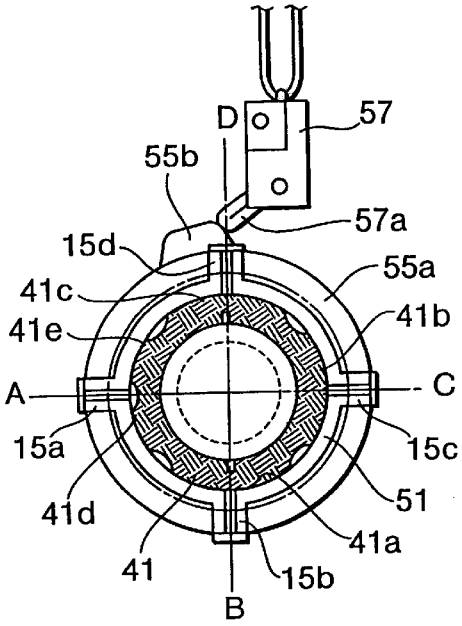
FIG. 8 is a plan view showing the switching mechanism in an OFF condition.

FIG. 8 shows the switching mechanism 15 in the OFF condition, with the protrusion 55*b* positioned to turn OFF the micro switch 57. When the protrusion 55*b* of the top member 55 rotates into the OFF position shown in FIG. 8, the micro switch 57 is turned from ON to OFF, so that the origin position can be determined as will be described later. In the OFF position, all of the first indentations 41*a* to 41*d* and the second indentation 41*e* of the switching member 41 are positioned shifted out of alignment with the suction holes 15*a* to 15*d* of the base member 51.

Figure 9:
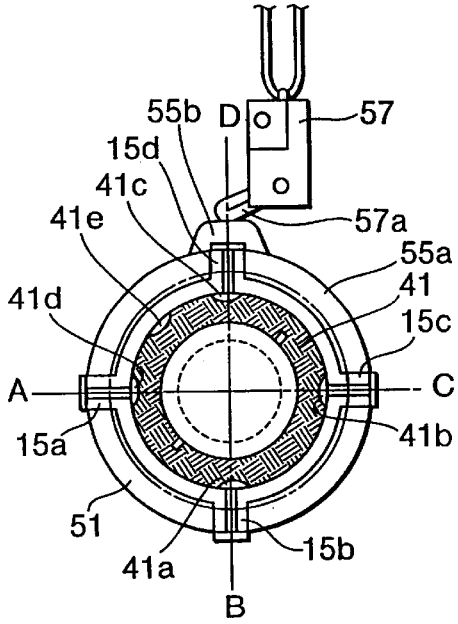
FIG. 9 is a plan view showing the switching mechanism in the waiting condition.

FIG. 9 shows the switching mechanism 15 in the waiting condition of FIGS. 4 (A) and 4 (B). When the switching member 41 is rotated from the OFF condition in the counterclockwise direction to the 348 degree orientation shown in FIG. 9, then the switching mechanism 15 will be placed in the waiting condition, wherein the first indentations 41*a* to 41*d* are in alignment with all of the suction holes 15*a* to 15*d* of the base member 51.

Figure 10:
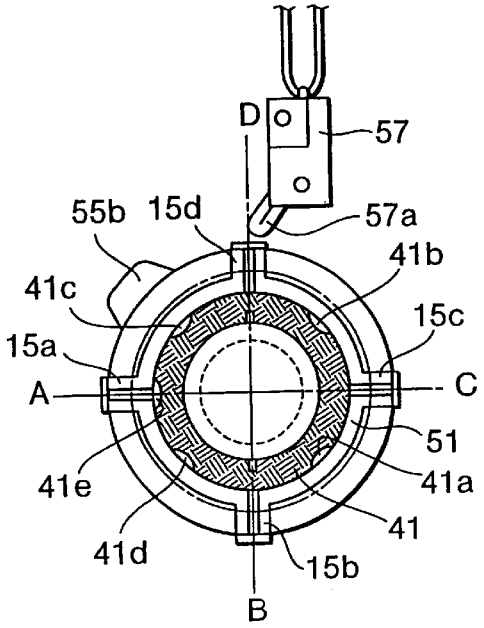
FIG. 10 is a plan view showing the switching mechanism in an A suction condition.

FIG. 10 shows the switching mechanism 15 in an A suction for purging the ink jet nozzle 3*a*. To place the switching mechanism 15 into the A suction condition, the switching member 41 is rotated from the OFF condition by 33 degrees in the counterclockwise direction as viewed in FIG. 8. In the A suction condition, the second indentation 41*e* of the switching member 41 is aligned with the suction hole 15*a* of the base member 51, so that the nozzle row 3*a* is placed in fluid communication with the suction pump 13 through the suction hole 15*a* and the tube 17*a*. As a result, the nozzle row 3*a* can be purged by driving the suction pump 13 while the switching mechanism 15 is in the A suction condition.

Figure 11:
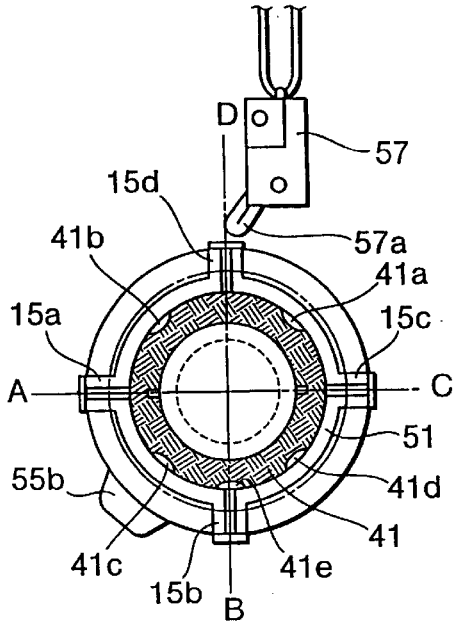
FIG. 11 is a plan view showing the switching mechanism in a B suction condition.

FIG. 11 shows the switching mechanism 15 in a B suction condition for purging the ink jet nozzle 3*b*. To place the switching mechanism 15 into the B suction condition, the switching member 41 is rotated from the OFF condition by 123 degrees in the counterclockwise direction as viewed in FIG. 8. In the B suction condition, the second indentation 41*e* of the switching member 41 is aligned with the suction hole 15*b* of the base member 51, so that the nozzle row 3*b* is placed in fluid communication with the suction pump 13 through the suction hole 15*b* and the tube 17*b*. As a result, the nozzle row 3*b* can be purged by driving the suction pump 13 while the switching mechanism 15 is in the B suction condition.

Figure 12:
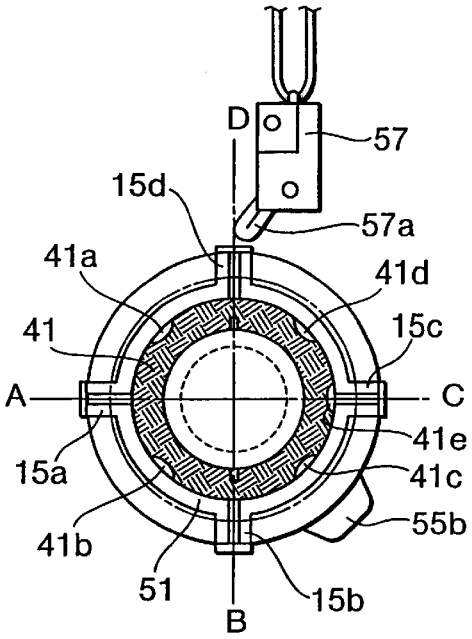
FIG. 12 is a plan view showing the switching mechanism in a C suction condition.

FIG. 12 shows the switching mechanism 15 in a C suction condition for purging the nozzle row 3*c*. To place the switching mechanism 15 into the C suction condition, the switching member 41 is rotated from the OFF condition by 213 degrees in the counterclockwise direction as viewed in FIG. 8. In the C suction condition, the second indentation 41*e* of the switching member 41 is aligned with the suction hole 15*c* of the base member 51, so that the nozzle row 3*c* is placed in fluid communication with the suction pump 13 through the suction hole 15*c* and the tube 17*c*. As a result, the nozzle row 3*c* can be purged by driving the suction pump 13 while the switching mechanism 15 is in the C suction condition.

Figure 13:
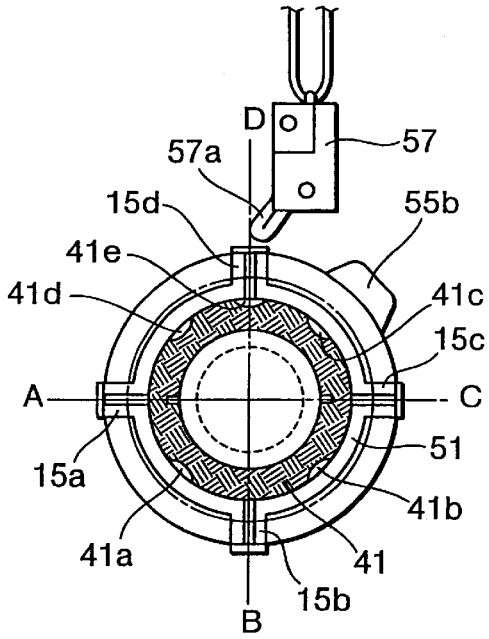
FIG. 13 is a plan view showing the switching mechanism in a D suction condition.

FIG. 13 shows the switching mechanism 15 in a D suction condition for purging the nozzle row 3*d*. To place the switching mechanism 15 into the D suction condition, the switching member 41 is rotated from the OFF condition by 303 degrees in the counterclockwise direction as viewed in FIG. 8. In the D suction condition, the second indentation 41*e* of the switching member 41 is aligned with the suction hole 15*d* of the base member 51, so that the nozzle row 3*d* is placed in fluid communication with the suction pump 13 through the suction hole 15*d* and the tube 17*d*. As a result, the nozzle row 3*d* can be purged by driving the suction pump 13 while the switching mechanism 15 is in the D suction condition.

Figure 14:
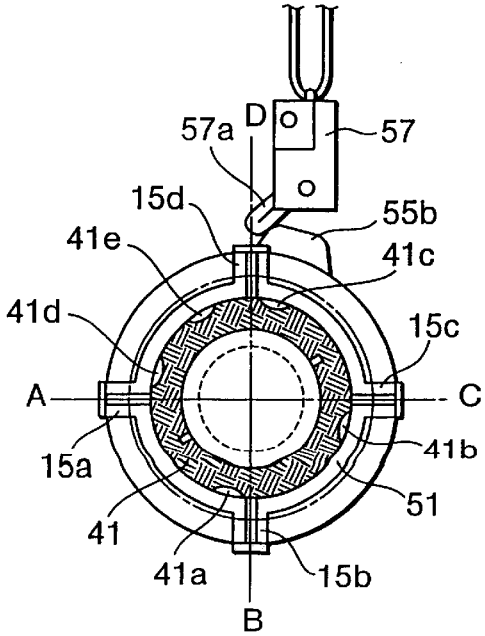
FIG. 14 is a plan view showing the switching mechanism in an ON detection position.

FIG. 14 shows the switching mechanism 15 in a detection position wherein the protrusion 55*b* of the top member 55 presses the detection rib 57*a* of the micro switch 57 upward. To place the switching mechanism 15 into the ON detection position, the switching member 41 is rotated from the OFF condition by 332 degrees in the counterclockwise direction as viewed in FIG. 8. According to the present embodiment, when the switching member 41 is rotated further counterclockwise from the ON detection position of FIG. 14 into the OFF condition of FIG. 8, then the micro switch 57 is turned OFF, which indicates that the switching mechanism 15 is at its origin, that is, at the 0 degree orientation shown in FIG. 8. By determining the origin in this manner, the switching mechanism 15 can be precisely controlled to move into the waiting condition and into the A to D suction conditions.

Figures 15, 16, 17, 18, 19, 20:
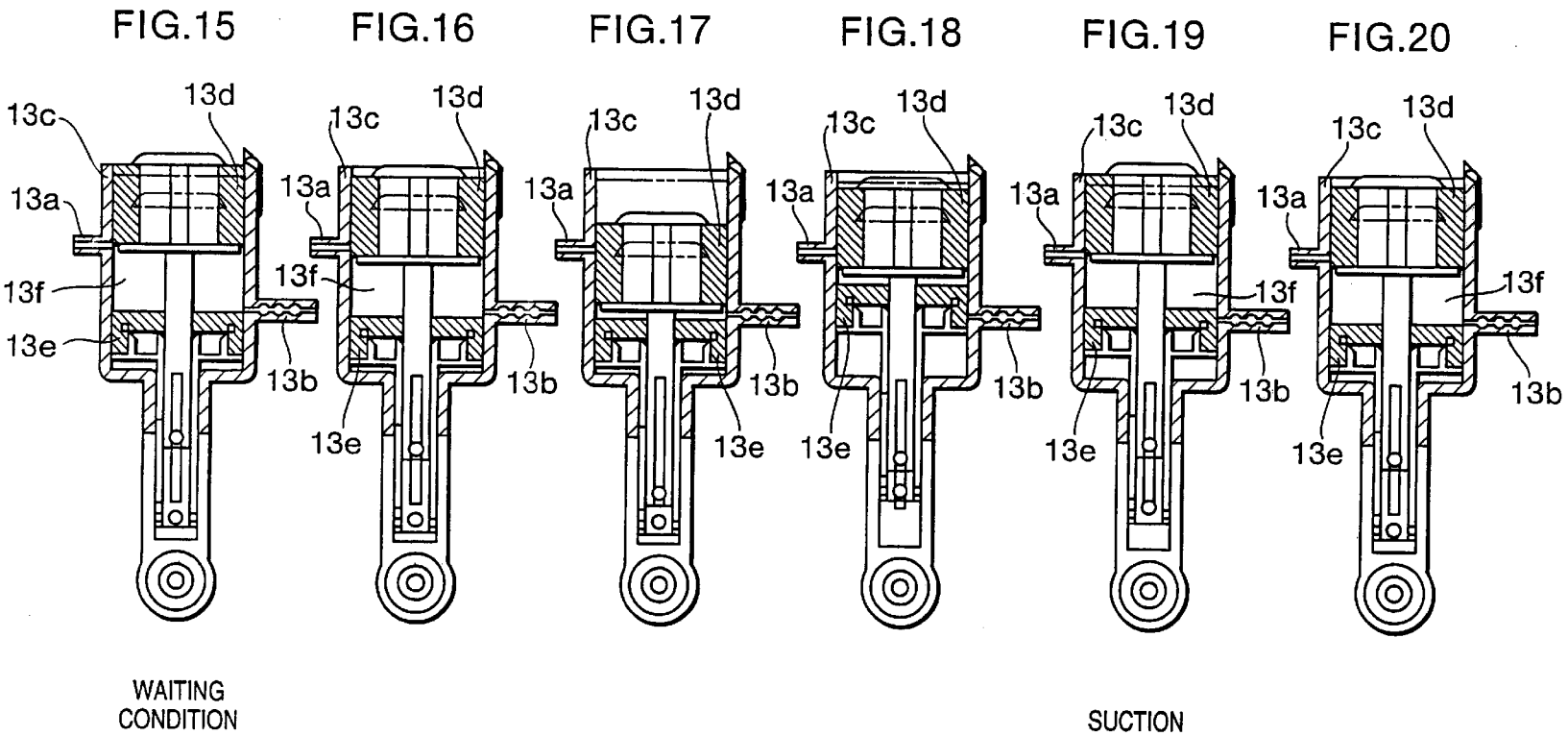
FIG. 15 is a cross-sectional view showing a suction pump in the waiting condition.
FIG. 16 is a cross-sectional view showing the suction pump when an upper piston thereof starts to move downward to discharge air.
FIG. 17 is a cross-sectional view showing the suction pump with the upper piston in its lowermost position.
FIG. 18 is a cross-sectional view showing the suction pump with the upper piston and a lower piston moving upward together.
FIG. 19 is a cross-sectional view showing the suction pump as the lower piston alone beings to move downward.
FIG. 20 is a cross-sectional view showing the suction pump as the upper piston begins to move downward.

Next, the suction and discharge operations of the suction pump 13 will be described while referring to FIGS. 15 to 23. As shown in FIG. 15, the suction pump 13 includes a cylinder 13*c*, an upper piston 13*d*, and a lower piston 13*e*. The cylinder 13*c* is formed with a suction port 13*a* and a discharge port 13*b*. The discharge port 13*b* is in fluid communication with atmosphere. The upper and lower pistons 13*d*, 13*e* are disposed in the cylinder 13*e*. A cylinder chamber 13*f* is defined between the pistons 13*d*, 13*e*.

FIG. 15 shows condition of the suction pump 13 during waiting condition. In the waiting condition, the upper piston 13*d* is at its uppermost position and the lower piston 13*e* is in it lowermost position, and the suction hole 13*a* and the discharge port 13*b* are in fluid communication with each other through the cylinder chamber 13*f*. The suction pump 13 is placed into the waiting condition when the switching mechanism 15 is rotated into the waiting condition as shown in FIG. 9. While the suction pump 13 is in the waiting condition, the nozzle rows 3*a* to 3*d* capped by the maintenance caps 9*a*, 9*b* are maintained in fluid communication with atmosphere.

When the suction pump 13 is started while in the waiting condition shown in FIG. 15, then as shown in FIG. 16 the upper piston 13*d* starts to move downward to discharge air from the cylinder chamber 13*f* through the discharge port 13*b*. Once the upper piston 13*d* reaches its lowermost position as shown in FIG. 17, then the upper piston 13*d* and the lower piston 13*e* move upward together as shown in FIG. 18 until the upper piston 13*d* returns to its uppermost position. Then as shown in FIG. 19 the lower piton alone beings to move downward so that the cylinder chamber 13*f* enlarges. As a result, a negative pressure develops in the cylinder chamber 13*f* that sucks ink from the selected nozzle row 3*a* to 3*d* through the suction port 13*a*. As soon as the lower piston 13*e* reaches its lowermost position, whereupon fluid communication is opened between the cylinder chamber 13*f* and the discharge port 13*b*, the upper piston 13*d* begins to move downward as shown in FIG. 20. This downward movement of the upper piston 13*d* closes off fluid communication between the suction port 13*a* and the cylinder chamber 13*f*, and discharges ink from the cylinder chamber 13*f* out through the discharge port 13*b*.

Figure 21:
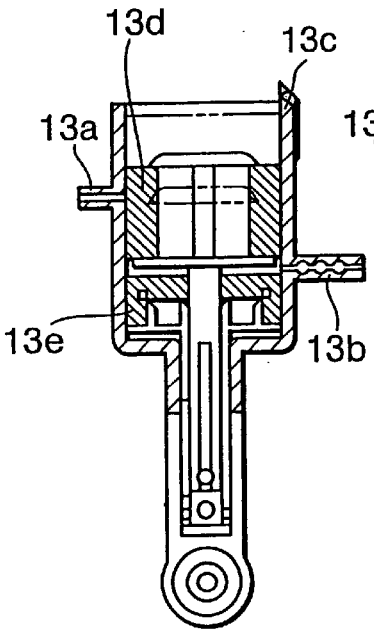
FIG. 21 is a cross-sectional view showing the suction pump with the upper piston at its lowermost position.
Figure 22:
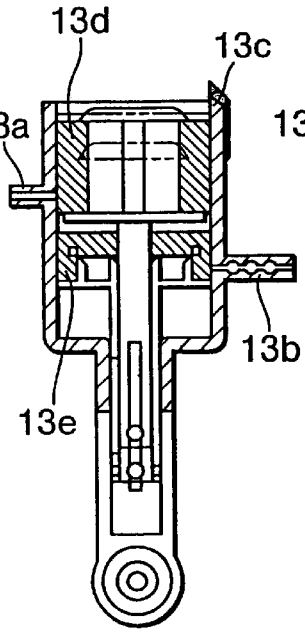
FIG. 22 is a cross-sectional view showing the suction pump as the upper piston and the lower piston begin to move upward together.
Figure 23:
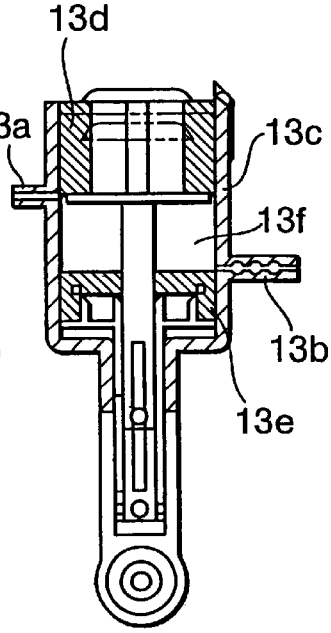
FIG. 23 is a cross-sectional view showing the suction pump with the lower piston again in its lowermost position.

By the time the upper piston 13*d* has reached its lowermost position as shown in FIG. 21, then all of the ink in the cylinder chamber 13*f* has been discharged out through the discharge port 13*b*, and the discharge operation is completed. Then, as shown in FIG. 22 the upper piston 13*d* and the lower piston 13*e* begin to move upward together. After the upper piston 13*d* has reached its uppermost position, then the lower piston 13*e* again moves downward to its lowermost position as shown in FIG. 23 while sucking in air through the suction port 13*a*. This returns the suction pump 13 to the waiting condition shown in FIG. 15.

By operating the suction pump 13 in this manner, then the one nozzle row selected by the switching mechanism 15 from the four nozzle rows 3*a* to 3*d* can be purged. While the switching mechanism 15 is in the waiting condition shown in FIG. 9 and the suction pump 13 is in the waiting condition shown in FIG. 14, all of the nozzle rows 3*a* to 3*d* capped by the maintenance caps 9*a*, 9*b* are maintained in fluid communication with atmosphere through the partitioned chambers 7*a* to 7*d* formed in the maintenance caps 9*a*, 9*b* and the suction pump 13.

The purge unit 1 according to the present embodiment uses the sheet supply motor 31 to both select a color nozzle row to be purged and also to perform suction and discharge operations. This achieves two effects. First, because the same drive source is used for both the nozzle row selection and for the suction/discharge operation, the number of required components can be reduced. Second, because the sheet supply motor is already provided for sheet feed operations, there is no need to provide a special drive source for nozzle row selection of for the suction/discharge operation.

As described above, the disc-shaped switching mechanism 15 includes the rotatable switching member 41, which is formed with the plurality of indentations 15*a* to 15*d* that can be easily selectively aligned with the suction holes 15*a* to 15*d*. With this configuration, a purge operation can be performed by connecting a single one of the partitioned chambers 7*a* to 7*d*. Because the nozzle rows can be selected by merely rotating the switching member 41, the switching process will not interfere with surrounding components even when space is greatly restricted. Also, purge operations are much easier to perform than a conventional purge device that moves the print head to select a color nozzle row to be purge.

When in the waiting condition, wherein purge operations are not performed, the first indentations 41*a* to 41*d* of the switching member 41 are positioned in alignment with the suction holes 15*a* to 15*d* provided in the base member 51. With this configuration, the partitioned chambers 7*a* to 7*d*, and consequently the nozzle rows 3*a* to 3*d*, can be maintained in fluid communication with atmosphere through the discharge port 13*b* of the suction pump 13. As a result, no positive pressure will be applied to the nozzles of the nozzles rows 3*a* to 3*d* even if this condition is maintained for a long period of time. Applying a positive pressure to the nozzles can adversely affect printing.

While the invention has been described in detail with reference to specific embodiments thereof, it would be apparent to those skilled in the art that various changes and modifications may be made therein without departing from the spirit of the invention, the scope of which is defined by the attached claims.

For example, in the embodiment two separate maintenance caps 9 are provided for each of two print heads 5, each formed with two nozzle rows, for ejecting four colors of ink. However, a single integral maintenance cap can be provided for the two heads 5. Also, the present invention can be applied to a variety of maintenance caps for a variety of heads having different nozzle numbers, and for ejecting different number of ink colors.

Although four suction holes 13*a* are provided to match the four different color nozzle rows 3, the number of suction holes need not match the number of nozzle rows or ink colors.

Also, the embodiment describes providing an individual partitioned chambers 7*a* to 7*d* for each nozzles row, so that the nozzle rows are separated from each other to enable purging each nozzle row independently. However, each partitioned chamber can be modified to isolate more than one nozzle row.

Also, the embodiment describes the nozzles rows as being aligned in parallel on a nozzle surface. However, the separate nozzle rows could be disposed aligned in a straight line, and each partitioned chamber modified to isolate a predetermined number of nozzles of the straight line of nozzles.

What is claimed is:

1. An ink jet printer, comprising:

a print head having a nozzle surface formed with a plurality of nozzle rows;

a cap member in intimate contact with the nozzle surface of the print head, the cap member being formed with partition walls that define partitioned chambers around the nozzle rows and being formed with suction holes in a one-to-one correspondence with the partitioned chambers, each suction hole being in fluid communication with a corresponding one of the partitioned chambers;

a suction pump that generates negative pressure;

a switching mechanism connected to the suction holes of the cap member and to the suction pump, the switching mechanism having a switching member that, by rotating, selectively switches the suction pump into fluid communication with one at a time of the partitioned chambers through the corresponding suction hole and out of fluid communication with any partitioned chamber other than a selected partitioned chamber;

a selection unit that drives rotation of the switching member of the switching mechanism to select one of the plurality of partitioned chambers; and a suction pump drive unit that drives the suction pump to develop a negative pressure in the selected partitioned chamber through the switching mechanism and the corresponding suction hole, thereby purging the corresponding nozzle row;

the switching mechanism including a cylindrical base member having a bottom surface and an outer circular peripheral surface, the bottom surface being formed with a discharge port in fluid communication with the suction pump, the outer circular peripheral surface being formed with suction ports in fluid communication with corresponding ones of the suction holes of the cap member, the switching member having a cylindrical shape and being rotatably fitted in the cylindrical base member, the cylindrical switching member having a circular outer peripheral surface formed with an indentation in fluid communication with the discharge port; and the switching mechanism including a switch that detects a start position of the cylindrical switching member, the selection unit driving rotation of the cylindrical switching member from the start position for certain degrees to selectively establish fluid communication between one of the suction ports and the discharge port to enable purge operations using the suction pump through the selected one of the partitioned chambers.

2. An ink jet printer as claimed in claim 1, wherein the cylindrical switching member is provided with a protrusion and the switch detects the start position by sensing the protrusion.

3. An ink jet printer as claimed in claim 2, wherein the cylindrical switching member is provided with a cut out portion.

4. An ink jet printer as claimed in claim 3, wherein the switching mechanism includes a plurality of first indentations in fluid communication with the discharge port, the first indentations being provided in a one-to-one correspondence with the suction ports to simultaneously establish fluid communication between all the suction ports and the discharge port when the indentations and the suction ports are aligned, the second indentation being provided at a position shifted from positions of a first indentations.

* * * * *